United States Patent [19]

Cooper et al.

[11] Patent Number: 4,822,433

[45] Date of Patent: Apr. 18, 1989

[54] EMULSION EXPLOSIVE COMPOSITION

[75] Inventors: John Cooper, Ayrshire, Scotland; Alan S. Baker, Berkshire, England

[73] Assignee: Imperial Chemical Industries PLC, London, England

[21] Appl. No.: 59,225

[22] Filed: Jun. 5, 1987

Related U.S. Application Data

[63] Continuation of Ser. No. 818,401, Jan. 13, 1986, abandoned, which is a continuation of Ser. No. 711,485, Mar. 13, 1985, abandoned.

[30] Foreign Application Priority Data

Mar. 21, 1984 [GB] United Kingdom ..... 8407302
Jun. 14, 1984 [GB] United Kingdom ..... 8415205

[51] Int. Cl.[4] ..... C06G 45/00

[52] U.S. Cl. ..... 149/2; 149/21; 149/46; 149/60; 149/61; 149/108.8; 149/109.6

[58] Field of Search ..... 149/2, 46, 60, 61, 108.8, 149/109.6, 21

[56] References Cited

U.S. PATENT DOCUMENTS

| | | | |
|---|---|---|---|
| 3,255,108 | 9/1966 | Wiese | 252/32.7 |
| 3,269,946 | 1/1966 | Wiese | 252/32.5 |
| 3,324,033 | 3/1966 | Knapp | 252/51.5 |
| 3,502,677 | 2/1970 | LeSuer | 260/268 |
| 3,513,093 | 9/1970 | LeSuer | 252/32.5 |
| 3,542,678 | 6/1970 | Bork | 252/51.5 |
| 3,576,743 | 12/1971 | Widmer | 252/51.5 |
| 3,632,511 | 1/1972 | Liao | 252/51.5 A |
| 3,639,242 | 7/1972 | LeSuer | 252/56 R |
| 3,755,169 | 12/1973 | Adams et al. | 252/35 |
| 4,216,040 | 8/1980 | Sudweeks et al. | 149/44 |
| 4,234,435 | 6/1980 | Meinhardt et al. | 252/51.5 A |
| 4,329,249 | 7/1982 | Forsberg | 252/34.7 |
| 4,357,184 | 11/1982 | Binet et al. | 149/41 |
| 4,368,133 | 2/1983 | Forsberg | 252/75 |
| 4,435,297 | 10/1984 | Forsberg | 252/34.7 |
| 4,447,348 | 4/1984 | Forsberg | 252/75 |
| 4,448,703 | 6/1984 | Forsberg | 252/75 |
| 4,471,091 | 3/1984 | Hayashi | 525/71 |
| 4,473,418 | 9/1984 | Bampfield et al. | 149/2 |
| 4,486,573 | 12/1984 | Hayashi | 525/285 |
| 4,489,194 | 6/1984 | Hayashi | 525/193 |
| 4,490,194 | 12/1984 | Cooper et al. | 149/45 |
| 4,490,195 | 12/1984 | Cooper et al. | 149/44 |
| 4,496,405 | 1/1985 | Cechanski | 149/2 |
| 4,509,955 | 11/1985 | Hayashi | 44/62 |
| 4,666,620 | 5/1987 | Forsberg | 252/75 |
| 4,708,753 | 11/1987 | Forsberg | 149/2 |
| 4,710,248 | 12/1987 | Yates et al. | 149/2 |
| 4,732,627 | 3/1988 | Cooper et al. | 149/2 |

FOREIGN PATENT DOCUMENTS

| | | |
|---|---|---|
| 1094044 | 7/1981 | Canada . |
| 1146836 | 1/1983 | Canada . |
| 850940 | 3/1985 | South Africa . |
| 850803 | 6/1985 | South Africa . |

*Primary Examiner*—Stephen J. Lechert, Jr.
*Attorney, Agent, or Firm*—Cushman, Darby and Cushman

[57] ABSTRACT

An emulsion explosive composition comprising a discontinuous phase containing an oxygen-supplying component and an organic medium forming a continuous phase wherein the oxygen-supplying component and organic medium are capable of forming an emulsion which, in the absence of a supplementary adjuvant, exhibits an electrical conductivity measured at 60° C., not exceeding 60,000 picomhos/meter. Such conductivity may be achieved by inclusion of a modifier. The compositions exhibit improved storage characteristics.

17 Claims, No Drawings

EMULSION EXPLOSIVE COMPOSITION

This is a continuation of application Ser. No. 818,401, filed Jan. 13, 1986, which was abandoned upon the filing hereof which is a continuation of Ser. No. 711,485, filed Mar. 13, 1985, abandoned.

This invention relates to an explosive composition and, in particular, to an emulsion explosive composition of the kind comprising a discontinuous oxidiser phase dispersed throughout a continuous fuel phase which is substantially immiscible with the discontinuous phase.

Commercially available emulsion explosive compositions generally comprise an external or continuous organic fuel phase in which discrete droplets of an aqueous solution of an oxygen-supplying source are dispersed as an internal or discontinuous phase. Such compositions are conventionally described as water-in-oil emulsion explosive compositions, and examples thereof have been described, inter alia, in U.S. Pat. Nos. 3,447,978, 3,674,578, 3,770,522, 4,104,092, 4,111,727, 4,149,916 and 4,149,917.

For certain applications the water content of the oxidiser phase of the emulsion explosive may be completely eliminated or at least reduced to a low level—for example, to less than 4% by weight of the total emulsion composition. Such compositions are conventionally referred to as melt-in-oil or melt-in-fuel emulsion explosives and have been described, inter alia, in U.S. Pat. No. 4,248,644.

The term "emulsion explosive composition" is hereinafter employed to embrace compositions of both the water-in-oil (fuel) and melt-in-oil (fuel) types.

Formation of an emulsion explosive composition is generally effected in the presence of a surface tension-modifying emulsifier selected to promote subdivision of the droplets of the oxidiser phase and dispersion thereof in the continuous phase. In addition, the emulsifier is believed to exist as a molecular coating layer on the surface of the droplets thereby to reduce incipient breakdown of the emulsion by inhibiting coalescence and agglomeration of the droplets.

The droplets of the oxidiser phase are inherently metastable and exhibit a tendency to crystallise. Growth of the resultant crystals tends to impair the sensitivity to detonation of the emulsion explosive compositions, and attendant interlocking of the crystal matrices renders the compositions solid and, therefore, difficult to prime. Conventional emulsion explosive compositions therefore generally exhibit a progressive deterioration of explosive performance resulting from the ageing process which occurs during the storage and or transporting period elapsing between manufacture and eventual use of the explosive.

Various attempts to improve the storage characteristics of emulsion explosive compositions have hitherto concentrated on the emulsifier component of the compositions and, in particular, on the selection of suitable emulsifiers, or blends thereof, which are designed to suppress coalescence of the supersaturated droplets of the oxidiser salt present in the discontinuous phase. Thus it has been proposed in British Patent specification GB No. 2 042 495 to provide a water-in-oil emulsion blasting composition having as the sole emulsifier an organic cationic emulsifier comprising a hydrophilic portion and a lipophilic portion, the latter being an unsaturated hydrocarbon chain. The unsaturated emulsifier may be a fatty acid amine or ammonium salt having a chain length of from 14 to 22 carbon atoms and is said to function as a crystal habit modifier to control and limit the growth of crystals in the oxidiser salt solution. However, such emulsion explosive compositions are relatively insensitive to detonation (not cap sensitive—i.e. incapable of detonation by a detonator of magnitude less than a standard No.8 detonator) and, as prepared, have critical diameters (below which cartridges filled with the composition will not detonate) of the order of 19 mm. The compositions are therefore reliably effective and of commercial utility as blasting agents only in cartridges having a diameter of at least 25 mm. Smaller critical diameter utility is achieved only by the inclusion in the compositions of a significant proportion of a eutectic-forming salt, such as calcium nitrate, which reduces the amount of gas generated on detonation and therefore adversely affects the explosive performance.

The straight hydrocarbon chain component of emulsifiers previously employed in the production of emulsion explosive compositions was generally of a saturated nature, but compositions produced in accordance with GB No. 2 042 495 are said therein, by virtue of the presence of an unsaturated straight hydrocarbon chain as the lipophilic portion of the emulsifier, to be more stable and to have a higher sensitivity than compositions employing emulsifiers containing a saturated hydrocarbon chain. Furthermore, the unsaturated straight chain emulsifiers were found to be far superior to their saturated equivalents in inhibiting crystal growth from the oxidiser phase.

We have now devised a cap sensitive emulsion explosive composition exhibiting a surprising, and significant, improvement in storage stability.

Accordingly, the present invention provides an emulsion explosive composition comprising a discontinuous phase containing an oxygen-supplying component and an organic medium forming a continuous phase wherein the oxygen-supplying component and organic medium are capable of forming an emulsion which, in the absence of a supplementary adjuvant, exhibits an electrical conductivity measured at a temperature of 60° C., not exceeding 60,000 picomhos/meter.

The invention further provides a process for producing an emulsion explosive composition comprising emulsifying an oxygen-supplying component and an organic medium to form an emulsion in which the oxygen-supplying component forms at least part of the discontinuous phase and the organic medium forms at least part of the continuous phase wherein the emulsification is effected in the presence of a modifier which is capable of reducing the electrical conductivity, measured at a temperature of 60° C., of an emulsion formed from the oxygen-supplying salt component and organic medium, in the absence of a supplementary adjuvant, to a value not exceeding 60,000 picomhos/meter.

By selecting the emulsifiable oxygen-supplying component and organic medium such that an emulsion explosive composition having the specified low electrical conductivity can be formed therefrom we have observed that a surprising improvement in the storage stability of the explosive composition can be achieved. An adequate storage life is generally achieved when the electrical conductivity (60° C.) of the emulsion does not exceed 60,000 picomhos/meter, but preferred explosives exhibit a conductivity of less than 20,000 picomhos/meter. A particularly desirable emulsion explosive composition, exhibiting long storage stability, has an electrical conductivity (60° C.) of less than 2,000 and preferably less than 200, picomhos/meter.

Achievement of the specified electrical conductivity values may require the presence of a conductivity modifier, as hereinafter described.

Emulsion explosive compositions conventionally contain at least one adjuvant to improve or modify explosive performance. Such adjuvants include waxes to modify rheology characteristics, voiding agents such as gas bubbles, porous particles or microballoons, to reduce density, and solid particulate materials such as carbon or aluminium, to act as supplementary fuel components. Such materials influence electrical conductivity measurements to varying degrees and are likely to mask any decrease in conductivity conferred by a modifier in accordance with the invention. Values of electrical conductivity herein employed, are therefore determined on emulsion compositions devoid of adjuvants of any kind which will influence the measurement of electrical conductivity. In practice, to ensure reproducibility of measurements, an emulsion composition is formed by vigorously stirring a solution or dispersion (usually aqueous) of the oxidiser component into the organic continuous phase medium in a planetary mixer at a temperature of at least 70° C. for a period of five minutes. Emulsification may be effected in the presence of a suitable modifier, or the latter may be stirred in to an already formed emulsion. The electrical conductivity of the resultant emulsion is then measured in a conductivity cell.

The cell comprises a pair of 304 stainless steel planar electrodes arranged in parallel and maintained at a separation of 3 mm by peripheral spacers of polymethylmethacrylate (ICI's 'Perspex' (Trade Mark) brand is suitable). Each electrode has an operative surface area of 10 $cm^2$, and attached to the rear surface of each plate is a sinusoidal conduit through which a thermal medium (e.g. hot water) may be circulated to maintain the cell at a temperature of 60° C.—as indicated by a suitable thermocouple probe located in a port in one of the electrode plates.

A sample of emulsion, at a temperature above the crystallisation point thereof, is placed between the plates which are squeezed together to expel excess emulsion, the peripheral spacers ensuring that a constant volume is employed in successive evaluations. Thermal fluid is then circulated through the conduit until a steady temperature of 60° C. is recorded by the thermocouple, and the electrical conductivity of the sample in the cell is measured using a Fluke conductivity meter, Type 8050A.

In the case of an emulsion explosive composition containing an adjuvant, it is possible to extract the oxidiser component and organic medium by dissolution in appropriate solvent(s), to recover the extracted components, e.g. by distillation, and to reformulate an emulsion devoid of adjuvant, in accordance with the aforementioned technique, to enable an appropriate measurement of electrical conductivity to be effected.

Although the invention is herein defined in terms of an electrical conductivity measured in the absence of an adjuvant, such as wax, metallic particles, microspheres, voids etc, it will be understood that any such adjuvant may be included in the compositions of the invention.

Desirably a conductivity modifier, for use in accordance with the invention, should also function at least to a degree, as an emulsifier. It should, therefore, when employed in an effective amount, be capable of promoting a relatively permanent dispersion of the discontinuous phase component(s) in the continuous phase medium. Such a modifier will therefore be an emulsifier of the water(or melt)-in-oil type which promotes or facilitates the formation of an emulsion in which the discontinuous phase comprises an aqueous (or melt) medium and the continuous phase comprises an oily or organic medium. Conveniently, therefore the modifier comprises a hydrophilic moiety and a lipophilic moiety and generally will be strongly lipophilic, i.e. exhibiting a high affinity for the oily or organic medium.

The lipophilic moiety of the modifier may be either monomeric or polymeric in nature, provided that it contains a chain structure of sufficient length to confer the necessary emulsification characteristics. The chain structure should incorporate a backbone sequence of at least 10, and preferably not more than 500, linked atoms; these may be entirely carbon atoms, or they may be predominantly carbon atoms interrupted by hetero atoms such as oxygen or nitrogen. Desirably, the lipophilic moiety comprises a terminal reactive grouping, such as a hydroxyl, amino, carboxyl or carboxylic acid anhydride group, to promote linkage of the lipophilic to an appropriate hydrophilic moiety.

A preferred type of lipophilic moiety is a saturated or unsaturated hydrocarbon chain derived, for example, from a polymer of a mono-olefin, the polymer chain containing from 40 to 500 carbon atoms. Suitable polyolefins include those derived from olefins containing from 2 to 6 carbon atoms, in particular ethylene propylene, butene-1 and isoprene, but especially isobutene. Conveniently such a moiety may be provided by a poly-[alk(en)yl]succinic anhydride. These are commercially available materials which are made by an addition reaction at an elevated temperature between a polyolefin containing a terminal unsaturated group and maleic anhydride, optionally in the presence of a halogen catalyst. Typical poly(isobutylene)succinic anhydrides have number average molecular weights in the range 400 to 5000.

The succinic anhydride residue in the above mentioned compounds provides a convenient means of attaching the lipophilic hydrocarbon chain to the hydrophilic moiety of the conductivity modifier, as discussed below.

Another useful type of lipophilic moiety is that derived from a polymer obtained by the interesterification of one or more saturated or unsaturated long chain (e.g. up to 25 carbon atoms) monohydroxy monocarboxylic acids, optionally in admixture with a minor proportion of one or more non-hydroxylic monocarboxylic acids (the latter acting as chain terminator). Commercially available 12-hydroxystearic acid normally contains a minor amount of stearic acid and this substance, for example, may conveniently be used with or without admixture of further monofunctional material to yield by interesterification a suitable complex monocarboxylic acid. Depending upon the proportion of non-hydroxylic material present, the molecular weight of the resulting complex acid may vary from 500 to 5000.

Interesterification of the monohydroxy and nonhydroxylic monocarboxylic acids may be effected by known techniques, for example by heating the reactants in a hydrocarbon solvent such as xylene, in the presence of a catalyst such as tetrabutyltitanate.

The interesterification products contain in the molecule a terminal carboxyl group which provides a means of attaching the lipophilic polyester chain to a suitable hydrophilic grouping.

The hydrophilic moiety of a modifier for use in accordance with the invention is polar in character and suitably comprises an organic residue having a molecular weight not exceeding 450, preferably not exceeding 300 and particularly preferably not exceeding 200. In determining the aformentioned molecular weights any contribution from an ionic moiety, optionally introduced as hereinafter described, is to be disregarded. The organic residue is desirably monomeric, although oligomeric groupings—containing, for example, not more than about 10 repeat units—may be employed, provided the molecular weight thereof is within the aforementioned limit. Suitable monomeric groupings may be derived from polyols such as glycerol, pentaerythritol, and sorbitol or an internal anhydride thereof (e.g. sorbitan); from amines such as ethylene diamine, diethylene triamine and dimethylaminopropylamine; from amides such as 2-hydroxypropanolamide; from alkanolamines such as ethanolamine or diethanolamine; and from heterocyclics such as oxazoline or imidazoline. Suitable oligomeric groupings include short-chain poly(oxyethylene) groups (i.e. those containing up to 10 ethylene oxide units).

The simplest type of modifier consists of a single monomeric or oligomeric grouping attached to the lipophilic moiety.

Formation of conductivity modifiers for use in accordance with the invention may be effected by conventional procedures depending upon the chemical nature of the lipophilic and hydrophilic moieties involved. For example, where the lipophilic moiety is a poly(isobutylene)succinic anhydride and the hydrophilic moiety is a polyol or an alkanolamine, the anhydride group can be caused to react with the hydroxyl or amino group by heating the two components together in a suitable solvent, in the presence of a catalyst if desired. If desired, formation of such modifiers may be effected in situ, for example, by heating the two components (preheated if necessary) in the organic continuous phase medium of the emulsion for an appropriate time and at an appropriate temperature. Where the lipophilic moiety is a complex monocarboxylic acid, the carboxyl group can be caused similarly to react with the hydroxyl or amino groups in a polyol or alkanolamine.

The modifiers may be of a non-ionic character, as in the illustrations discussed above, but they may alternatively be of an anionic character as, for example, the substances obtained by reacting free hydroxyl groups present in a non-ionic modifier with a strong acid such as phosphoric acid, and if desired subsequently neutralising the product with ammonia or an organic base. Yet again, they may be cationic in nature, as, for example, where the hydrophilic moiety incorporates the residue of a polyamine or a heterocyclic compound.

The compositions of the invention may comprise a single modifier, although a mixture of two or more modifiers may be employed, if desired. The modifier(s) may be incorporated into the emulsification medium in conventional manner.

The amount of modifier required in the compositions of the invention is generally small. The required amount of modifier is readily assessed by simple experimental trial, and is generally observed to be within a range of from 0.1 to 5.0, preferably from 0.2 to 4.0, and particularly preferably from 0.5 to 2.5, % by weight of the total explosive composition.

Emulsifiers hitherto employed in the production of emulsion explosive compositions have conventionally been of the water(or melt)-in-oil type, as hereinbefore described, and generally exhibit a hydrophilic-lipophilic balance (HLB) of less than about 10. Such emulsifiers are herein described as conventional emulsifiers and if desired one or more thereof may (but need not) be included together with one or more modifiers in formulating the emulsion explosive compositions of the present invention. However, successful formulation and storage stability is readily achieved in the absence of a conventional emulsifier.

Many suitable conventional emulsifiers have been described in detail in the literature and include, for example, sorbitan esters, such as sorbitan sesquioleate, sorbitan monooleate, sorbitan monopalmitate, sorbitan monostearate and sorbitan tristearate, the mono- and diglycerides of fat-forming fatty acids, soyabean lecithin and derivatives of lanolin, such as isopropyl esters of lanolin fatty acids, mixtures of higher molecular weight fatty alcohols and wax esters, ethoxylated fatty ethers, such as polyoxyethylene(4) lauryl ether, polyoxyethylene(2) oleyl ether, polyoxyethylene(2) stearyl ether, polyoxyalkylene oleyl laurate, and substituted oxazolines, such as 2-oleyl-4,4'-bis(hydroxymethyl)-2-oxazoline. Suitable mixtures of such conventional emulsifiers may also be selected for use, together with one or more modifiers, in the compositions of the present invention.

The required amount of conventional emulsifier is readily determined by simple experimentation, but generally the combined amount of modifier(s) and conventional emulsifier(s) will not exceed about 5% by weight of the total explosive composition. Higher proportions of emulsifier and/or modifier may be tolerated, excess amounts serving as a supplemental fuel for the composition, but, in general, economic considerations dictate that the amount be kept to a minimum commensurate with acceptable performance.

The oxygen-supplying component of the discontinuous phase suitably comprises any oxidiser salt capable of releasing oxygen in an explosive environment in an amount and at a rate sufficient to confer acceptable explosive characteristics on the emulsion composition. Inorganic oxidiser salts conventionally employed in the production of emulsion explosive compositions, and suitable for inclusion in the compositions of the present invention, are disclosed, for example, in U.S. Pat. No. 3,447,978 and include ammonium salts and salts of the alkali- and alkaline-earth metals—such as the nitrate, chlorate and perchlorate salts, and mixtures thereof. Other suitable salts include hydrazine nitrate and urea perchlorate. The oxygen-supplying component may also comprise an acid, such as nitric acid.

Ammonium nitrate is preferably employed as a primary oxidiser salt comprising at least 50% by weight of the oxygen-supplying salt component, supplemented, if desired, by a minor (not exceeding 50% by weight) amount of a secondary oxidiser component, such as calcium nitrate or sodium nitrate. A secondary oxidiser component may be incorporated into an aqueous discontinuous phase but its presence is particularly desirable if the oxygen-supplying component is to be incorporated into the emulsion in the form of a melt, i.e. in the substantial or complete absence of water from the discontinuous phase. Suitable secondary oxidiser components which form an eutectic melt when heated together with ammonium nitrate include inorganic oxidiser salts of the kind hereinbefore described, such as the nitrates of lead, silver, sodium and calcium, and organic compounds, such as mono- and poly-hydroxylic compounds including methanol, ethylene glycol, glycerol, mannitol, sorbitol and pentaerythritol, carbohydrates, such as glucose, sucrose, fructose and maltose, aliphatic carboxylic acids and their derivatives, such as formic acid and formamide, and organo-nitrogen compounds, such as urea, methylamine nitrate and hexamethylene tetramine, and mixtures thereof.

If desired, the emulsion composition may additionally comprise a solid oxidiser component, such as solid ammonium nitrate or ammonium perchlorate—conveniently in the form of prills or powder, respectively.

Typically, the discontinuous phase may comprise from about 20 to about 97%, more usually from 30 to 95%, and preferably from 70 to 95% by weight of the total emulsion explosive composition. The discontinuous phase may be entirely devoid of water, in the case of a melt emulsion, or may comprise relatively minor amounts of water, for example—from 2 to 30%, more usually from 4 to 25% and preferably from 8 to 18% by weight of the total composition.

The organic medium capable of forming the continuous phase of an emulsion explosive composition in accordance with the invention serves as a fuel for the explosive composition and should be substantially insoluble in the component(s) of the discontinuous phase with which it should be capable of forming an emulsion in the presence of an effective amount of an appropriate emulsifying agent. Ease of emulsification depends, inter alia, on the viscosity of the organic medium, and although the resultant emulsion may have a substantially solid continuous phase, the organic medium should be capable of existing initially in a sufficiently fluid state, if necessary in response to appropriate temperature adjustment, to permit emulsification to proceed.

Suitable organic media which are capable of existing in the liquid state at convenient emulsion formulation temperatures include saturated and unsaturated aliphatic and aromatic hydrocarbons, and mixtures thereof. Preferred media include refined (white) mineral oil, diesel oil, paraffin oil, petroleum distillates, benzene, toluene, dinitrotoluene, styrene, xylenes, and mixtures thereof.

In addition to the organic fuel medium the continuous phase may optionally comprise a wax to control the rheology of the system, although the presence of a wax is not necessary to achieve the desired conductivity levels. Suitable waxes include petroleum, mineral, animal, and insect waxes. The preferred waxes have melting temperatures of at least 30° C. and are readily compatible with the formed emulsion. A preferred wax has a melting temperature in a range of from about 40° C. to 75° C.

Generally, the continuous phase (including wax(es), if present) comprises from 1 to 10, and preferably from 2 to 8% by weight of the total explosive composition, but higher proportions, for example in a range of from 1 up to 15 or even 20% may be tolerated.

If desired, additional components may be incorporated into the compositions of the present invention. For example, supplementary fuel components may be included. Typical supplementary fuel components suitable for incorporation into the discontinuous phase include soluble carbohydrate materials, such as glucose, sucrose, fructose, maltose and molasses, lower glycols, formamide, urea, methylamine nitrate, hexamethylene tetramine, hexamethylene tetramine nitrate, and other organic nitrates.

Supplementary fuel components which may be incorporated into the continuous phase include fatty acids, higher alcohols, vegetable oils, aliphatic and aromatic nitro organic compounds, such as dinitrotoluene, nitrate esters, and solid particulate materials such as coal, graphite, carbon, sulphur, aluminium and magnesium.

Combinations of the hereinbefore described supplementary fuel components may be employed, if desired.

The amount of supplementary fuel component(s) employed may be varied in accordance with the required characteristics of the compositions, but, in general, will be in a range of from 0 to 30, preferably from 5 to 25, % by weight of the total emulsion explosive composition.

Thickening and or cross-linking agents may be included in the compositions, if desired—generally in small amounts up to the order of 10, and preferably from 1 to 5, % by weight of the total explosive composition. Typical thickening agents include natural gums, such as guar gum or derivatives thereof, and synthetic polymers, particularly those derived from acrylamide.

Minor amounts of non-volatile, water insoluble polymeric or elastomeric materials, such as natural rubber, synthetic rubber and polyisobutylene may be incorporated into the continuous phase. Suitable polymeric additives include butadiene-styrene, isoprene-isobutylene, or isobutylene-ethylene copolymers. Terpolymers thereof may also be employed to modify the continuous phase, and in particular to improve the retention of occluded gases in the compositions.

Preferably, the emulsion explosive compositions of the present invention comprise a discontinuous gaseous component to reduce their density (to less than 1.5, and preferably to from about 0.8 to about 1.4 gm/cc) and enhance their sensitivity. The gaseous component, usually air, may be incorporated into the compositions of the present invention as fine gas bubbles dispersed throughout the composition, hollow particles which are often referred to as microballoons or microspheres, porous particles, or mixtures thereof. A discontinuous phase of fine gas bubbles may be incorporated into the compositions of the present invention by mechanical agitation, injection or bubbling the gas through the composition, or by chemical generation of the gas in situ. Suitable chemicals for the in situ generation of gas bubbles include peroxides, such as hydrogen peroxide, nitrites, such as sodium nitrite, nitrosoamines, such as N,N'-dinitrosopentamethylenetetramine, alkali metal borohydrides, such as sodium borohydride, and carbonates, such as sodium carbonate. Preferred chemicals for the in situ generation of gas bubbles are nitrous acid and its salts which decompose under conditions of acid pH to produce gas bubbles. Thiourea may be used to accelerate the decomposition of a nitrite gassing agent. Suitable hollow particles include small hollow microspheres of glass and resinous materials, such as phenolformaldehyde and ureaformaldehyde. Suitable porous materials include expanded minerals, such as perlite.

The gas component is usually added during cooling such that the prepared emulsion comprises from about 0.05 to 50% by volume of gas at ambient temperature and pressure. Conveniently the occluded gas is of bubble diameter below 200 μm, preferably below 1OO μm, more preferably between 20 and 90 μm and particularly between 40 and 70 μm, in proportions less than 50%, preferably between 40 and 3%, and particularly preferably between 30 and 10% by volume. Preferably at least 50% of the occluded gas will be in the form of bubbles or microspheres of 20 to 90 μm, preferably 40 to 70 μm internal diameter.

An emulsion explosive composition according to the present invention may be prepared by conventional emulsification techniques. Thus, the oxygen-supplying salt(s) may be dissolved in the aqueous phase at a temperature above the crystallisation point of the salt solution, preferably at a temperature in the range of from 25° to 110° C., and a mixture, preferably a solution, of modifier(s) and optional emulsifier(s), and organic phase is separately prepared, preferably at the same temperature as the salt solution. The aqueous phase is then added to the organic phase with rapid mixing to produce the emulsion explosive composition, mixing being continued until the formation is uniform. Optional solid and or gaseous components may then be introduced with further agitation until a homogeneous emulsion is obtained.

An emulsion explosive composition according to the invention may be used as such, or may be packaged into charges of appropriate dimensions.

The invention is illustrated by reference to the following Examples in which all parts and percentages are expressed on a weight basis unless otherwise stated.

EXAMPLE 1

This is a comparative Example, not according to the invention.

A mixture of ammonium nitrate (76.7 parts), and water (15.5 parts) was heated with stirring to a temperature of 85° C. to give an aqueous solution. The hot aqueous solution was added, with rapid stirring, to a solution of a conventional emulsifier, sorbitan sesquioleate (1.5 parts), in refined mineral oil (3.8 parts). Stirring was continued until a uniform emulsion was obtained.

A sample of the emulsion had an electrical conductivity, measured as hereinbefore described at 60° C., of 150,000 picomhos/meter.

Glass microballoons (2.5 parts; grade C15/250 supplied by 3M) were added to the remainder of the emulsion and thoroughly mixed therein.

The composition was allowed to cool and was then packaged into conventional cylindrical paper cartridges of varying diameters. The composition, as prepared, was found to have a critical diameter of 8 mm. Cartridges of 25 mm diameter were stored at a temperature of 10° C. and were periodically tested for cap sensitivity using a standard No.8 detonator.

After storage for 9 weeks the cartridges failed to detonate.

EXAMPLE 2

The procedure of Example 1 was repeated, save that the surfactant used was a mixture of 1.0 part of sorbitan sesquioleate and 0.5 part of a modifier comprising a 1:1 (molar) condensate of polyisobutenyl succinic anhydride (number average molecular weight 1200 with a molecular weight distribution up to 3000) and ethanolamine prepared by heating the two ingredients with stirring at a temperature of 70° C.

The electrical conductivity of the emulsion at 60° C. was 48,000 picomhos/meter.

Cartridges prepared, stored and tested, as described in Example 1, had a storage life in excess of 80 weeks at a temperature of 10° C.

EXAMPLE 3

The procedure of Example 2 was repeated, save that ethanolamine was replaced by diethanolamine to yield a modifier comprising a 1:1 (molar) condensate of polyisobutenyl succinic anhydride and diethanolamine.

The electrical conductivity of the emulsion at 60° C. was 50,000 picomhos/meter.

Cartridges prepared, stored and tested as described in Example 1 had a storage life in excess of 55 weeks at 10° C.

EXAMPLE 4

The procedure of Example 1 was repeated, save that the conventional surfactant was omitted, and 1.5 parts of the polyisobutenyl succinic anhydride/ethanolamine condensate described in Example 2 was used as modifier.

The electrical conductivity of the emulsion at 60° C. was 250 picomhos/meter.

Cartridges prepared, stored and tested as described in Example 1 had a storage life at 40° C. of greater than 80 weeks.

Similar cartridges stored at −30° C. for 12 weeks were still sensitive to a standard No. 8 detonator after warming to 5° C. In contrast, cartridges prepared from the emulsion described in Example 1 failed to detonate from a No. 8 detonator after storage for 1 day at −30° C. followed by warming to 5° C.

A sample of the emulsion was also packaged into a conventional cylindrical cartridge of 38 mm diameter. After storage for more than 12 weeks at a temperature of 40° C. the cartridge could be detonated by a detonating cord, having a charge weight of 10 grammes per meter length of pentaerythritol tetranitrate (PETN), taped to the exterior of the cartridge. A similar cartridge prepared using the composition of Example 8, stored and tested by the aforementioned test, failed to detonate after three weeks.

A further sample of the emulsion (2.5 kg) was packaged into a conventional cylindrical paper cartridge of 85 mm diameter, and tested for resistance to destabilisation at ambient temperature in response to mechanical events by dropping the cartridge from a height of 30 feet (9.14 m) onto a concrete base. The resultant temperature rise within the cartridge, which can be attributed to crystallisation of the ammonium nitrate component, was less than 3° C. as recorded by a thermocouple probe. A similar cartridge prepared using the composition of Example 8, and subjected to the drop test, experienced a temperature rise of 12° C.

EXAMPLE 5

The procedure of Example 4 was repeated, save that the modifier was 1.5 parts of a polyisobutenyl succinic anhydride/ethanolamine condensate (1:1) which had been reacted with one mole of phosphoric acid to yield the monophosphate derivative.

The electrical conductivity of the emulsion was 420 picomhos/meter at 60° C.

Cartridges prepared, stored and tested as described in Example 1 had a storage life at 40° C. of greater than 50 weeks.

EXAMPLE 6

The procedure of Example 4 was repeated save that the modifier was 1.5 parts of a 2:1 condensate of polyisobutenyl succinic anhydride (number average molecular weight 1200) and sorbitol.

The electrical conductivity of the emulsion at 60° C. was 1900 picomhos/meter.

Cartridges, prepared, stored and tested as described in Example 1 had a storage life at 40° C. of greater than 40 weeks.

EXAMPLE 7

The procedure of Example 4 was repeated, save that the oil phase consisted of 3.8 parts of Slackwax 431 (International Waxes, Agincourt, Ontario) and the sole modifier was 1.5 parts of a polyisobutenyl succinic anhydride (number average molecular weight 1200)/ethanolamine (1:1) condensate. An emulsion formed therefrom with vigorous stirring had an average droplet size of 1.5 μm.

The electrical conductivity of the emulsion at 60° C. was 170 picomhos/meter.

2.5 parts of glass microballoons (C15/250) were then added to the emulsion.

Cartridges prepared, stored and tested as described in Example 1 had a storage life at 40° C. of greater than 55 weeks.

EXAMPLE 8

This is a comparative example to demonstrate the influence on electrical conductivity of mixtures of microcrystalline wax and paraffin wax which are well known in the art as stabilisers for emulsion explosives.

An emulsion was prepared by the method of Example 1 from the following components:

| | parts |
|---|---|
| ammonium nitrate | 64.85 |
| refined mineral oil | 1.1 |
| paraffin wax (mp 50–62° C.) | 1.65 |
| microcrystalline wax (mp 72° C.) | 1.65 |
| sorbitan sesquioleate | 1.75 |
| water | 11.5 |
| sodium nitrate | 15.0 |
| microballoons (C15/250) | 2.5 |

The electrical conductivity of the emulsion at 60° C. was 100,000 picomhos/meter.

Cartridges prepared, stored and tested as described in Example 1 had a storage life at 40° C. of about 10 weeks.

A sample of the emulsion was also packaged into a conventional cylindrical cartridge of 38 mm diameter. After storage for 3 weeks at a temperature of 40° C. the cartridge could not be detonated by a detonating cord, having a charge weight of 10 grammes per meter length of pentaerythritol tetranitrate (PETN), taped to the exterior of the cartridge. A similar cartridge prepared using the composition of Example 4, stored and tested by the aforementioned test, could still be detonated after more than 12 weeks.

A further sample of the emulsion (2.5 kg) was packaged into a conventional cylindrical paper cartridge of 85 mm diameter, and tested for resistance to destabilisation at ambient temperature in response to mechanical events by dropping the cartridge from a height of 30 feet (9.14 m) onto a concrete base. The resultant temperature rise within the cartridge, which can be attributed to crystallisation of the ammonium nitrate component, was 12° C. as recorded by a thermocouple probe. A similar cartridge prepared using the composition of Example 4, and subjected to the drop test, experienced a temperature rise of less than 3° C.

EXAMPLE 9

The procedure of Example 1 was repeated save that the surfactant used was a mixture of sorbitan sesquioleate (0.75 part) and a 1:1 molar condensate (0.75 part) of poly-12-hydroxystearic acid (molecular weight: 600) with sorbitol.

The electrical conductivity of the emulsion at 60° C. was 50,000 picomhos/meter.

Cartridges prepared, stored and tested as described in Example 1 had a storage life at 10° C. of greater than 20 weeks.

EXAMPLE 10

An emulsion was prepared as described in Example 1 from the following components: ammonium nitrate (65.5 parts), sodium nitrate (15.0 parts), water (11.0 parts), paraffin oil (4.5 parts), sorbitan monooleate (0.75 part) and a 1:1 molar condensate (0.75 part) of poly-12-hyroxystearic acid (molecular weight: 1500) with tris(-hydroxymethyl)amino-methane.

The electrical conductivity of the emulsion at 60° C. was 50,000 picomhos/meter.

Glass microballoons (2.5 parts: type C15/250) were then added to the emulsion.

Cartridges prepared, stored and tested as described in Example 1 had a storage life at 10° C. of greater than 25 weeks.

EXAMPLE 11

The procedure of Example 4 was repeated save that the modifier was 1.5 parts of a 1:1 (molar ratio) condensate of polyisobutenyl succinic anhydride (average molecular weight 1200) and ethylene glycol.

The electrical conductivity of the emulsion at 60° C. was 320 picomhos/meter.

Cartridges prepared, stored and tested as described in Example 1 had a storage life at 40° C. of greater than 30 weeks.

EXAMPLE 12

The procedure of Example 4 was repeated save that the modifier was 1.5 parts of a 1:1 (molar ratio) condensate of polyisobutenyl succinic anhydride (number average molecular weight 1200) and dimethylaminopropylamine.

The electrical conductivity of the emulsion at 60° C. was 650 picomhos/meter.

Cartridges prepared stored and tested as described in Example 1 had a storage life at 40° C. of greater than 30 weeks.

EXAMPLE 13

The procedure of Example 4 was repeated save that the modifier was 1.5 parts of a 1:1 (molar ratio) condensate of polyisobutenyl succinic anhydride (number average molecular weight 1200) and diethylamino propylamine.

The electrical conductivity of the emulsion at 60° C. was 390 picomhos/meter.

Cartridges prepared, stored and tested as described in Example 1 had a storage life at 40° C. of greater than 25 weeks.

EXAMPLE 14

The procedure of Example 4 was repeated save that the modifier was 1.5 parts of a 1:1 condensate of polyisobutenyl succinic anhydride (number average molecular weight 1200) and N,N-dimethylamino ethanol.

The electrical conductivity of the emulsion at 60° C. was 550 picomhos/meter.

Cartridges prepared stored and tested as described in Example 1 had a storage life at 40° C. of greater than 25 weeks.

EXAMPLE 15

The procedure of Example 4 was repeated save that the modifier was 1.5 parts of a 1:1 polyisobutenyl succinic anhydride (number average molecular weight 1200), sorbitol condensate.

The electrical conductivity of the emulsion at 60° C. was 650 picomhos/meter.

Cartridges prepared stored and tested as described in Example 1 had a storage life at 40° C. of greater than 25 weeks.

EXAMPLE 16

The procedure of Example 4 was repeated save that the modifier was 1.5 parts of a 1:1 (molar ratio) condensate of polyisobutenyl succinic anhydride (number average molecular weight 1200) and glycine.

The electrical conductivity of the emulsion at 60° C. was 230 picomhos/meter.

Cartridges prepared stored and tested as described in Example 1 had a storage life at 40° C. at greater than 37 weeks.

EXAMPLE 17

The procedure of Example 4 was repeated save that the modifier was 1.5 parts of a 1:1 (molar ratio) condensate of polyisobutenyl succinic anhydride (number average molecular weight 800) and ethanolamine.

The electrical conductivity of the emulsion at 60° C. was 440 picomhos/meter.

Cartridges prepared, stored and tested as described in Example 1 had a storage life at 40° C. of greater than 20 weeks.

EXAMPLE 18

The procedure of Example 4 was repeated save that the modifier was 1.5 parts of a 1:1:1 (molar ratio) condensate of polyisobutenyl succinic anhydride (number average molecular weight 1200), ethanolamine and monochloroacetic acid.

The electrical conductivity of the emulsion at 60° C. was 420 picomhos/meter.

Cartridges prepared stored and tested as described in Example 1 had a storage life at 40° C. of greater than 30 weeks.

EXAMPLE 19

A base emulsion was prepared by the procedure of Example 1 from the following components:

| | parts |
|---|---|
| ammonium nitrate | 78.7 |
| water | 16.0 |
| Slackwax 431 (ex International Waxes) | 3.0 |
| refined mineral oil | 0.8 |

-continued

| | parts |
|---|---|
| Surfactant* | 1.5 |

The surfactant* was a 1:1 molar condensate of polyisobutenyl succinic anhydride (number average molecular weight 1200) and ethanolamine.

The electrical conductivity of the base emulsion at 60° C. was 180 picomhos/meter.

To 87.5 parts of the base emulsion were added 2.5 parts of glass micro balloons (C15/250; supplied by 3M) and 10 parts of porous ammonium nitrate prill.

Despite the inclusion of solid ammonium nitrate which normally induces a rapid loss of initiator sensitivity in the presence of prior art surfactants (see Example 20), cartridges of the composition in paper shells of 25 mm diameter were sensitive to initiation by a standard No. 8 detonator after storage for at least 55 weeks at a temperature of 40° C.

EXAMPLE 20

This is a comparative Example, not according to the invention.

The Procedure of Example 19 was repeated save that the surfactant used was sorbitan sesquioleate.

The electrical conductivity of the base emulsion at 60° C. was 170,000 picomhos/meter.

Cartridges prepared, stored and tested as described in Example 19 failed to detonate after storage for 1 week at a temperature of 40° C.

EXAMPLE 21

An explosive composition was prepared by mixing 60 parts of the emulsion described in Example 4 and 40 parts of ammonium nitrate/fuel oil (ANFO) (94 parts ammonium nitrate prill/6 parts fuel oil).

When filled into a 15 cm diameter wet borehole the composition detonated from a 400 gm pentolite (50:50 PETN/TNT) primer after one week from loading.

A similar explosive, but prepared from the emulsion containing sorbitan sesquioleate described in Example 1, failed to detonate after one day from loading.

EXAMPLE 22

The procedure of Example 4 was repeated save that the modifier was 1.5 parts of a 1:1 (molar ratio) condensate of a polybutenyl succinic anhydride (number average molecular weight 1200) in which the polybutenyl group contained 85% of isobutene, 10% of 2-butene and 5% of 1-butene) and ethanolamine.

The electrical conductivity of the emulsion at 60° C. was 320 picomhos/meter.

Cartridges prepared stored and tested as described in Example 1 had a storage life at 40° C. of greater than 25 weeks.

EXAMPLE 23

The procedure of Example 4 was repeated save that the modifier was 1.5 parts of a 1:1 (molar ratio) condensate of polyisobutenyl succinic anhydride (number average molecular weight 1200) and benzimidazole.

The electrical conductivity of the emulsion at 60° C. was 720 picomhos/meter.

Cartridges prepared stored and tested as described in Example 1 had a storage life at 40° C. of greater than 26 weeks.

EXAMPLE 24

This Example demonstrates in situ formation of a modifier.

1.42 parts of polyisobutenylsuccinic anhydride (number average molecular weight 1200) was added slowly with stirring to 0.08 parts of ethanolamine. Five minutes after the addition was complete, 3.8 parts of refined mineral oil was added and the mixture heated at 70°-80° C. for 4 hours. An emulsion explosive was formed directly from this mixture by adding a solution of 78.7 parts of ammonium nitrate dissolved in 16 parts of water, and heating to 80° C.

The emulsion so formed had an electrical conductivity at 60° C. at 300 picomhos/meter.

Glass microballoons (2.5 parts grade C15/250 supplied by 3M) were added, and the emulsion stored and tested as described in Example 1. The storage life of cartridges at 40° C. was greater than 55 weeks.

EXAMPLE 25

The procedure of Example 4 was repeated save that the modifier was a mixture of (a) 1 part of a 1:1 (molar ratio) condensate of polyisobutenyl succinic anhydride (number average molecular weight 1200) and ethanolamine, and (b) 0.5 part of a 1:1 (molar ratio) condensate of a carboxy terminated polyethylene (number average molecular weight 2000) (prepared by air oxidation of polyethylene at 120°-150° C. in the presence of a catalyst) and tris (hydroxymethyl) aminomethane.

The electrical conductivity of the emulsion at 60° C. was 95 picomhos/meter.

Cartridges prepared, stored and tested as described in Example 1 had a storage life at 40° C. of greater than 20 weeks.

EXAMPLE 26

The procedure of the Example 25 was repeated save that the oxidised polyethylene was reacted with an excess of tris (hydroxymethyl) aminomethane to yield an approximately 1:2 (molar ratio) oxidised polyethylene tris (hydroxymethyl) aminomethane adduct. 0.5 part of this adduct was used in combination with 1 part of the 1:1 (molar ratio) polyisobutenyl succinic anhydride/ethanolamine condensate.

The emulsion had an electrical conductivity at 60° C. of 980 picomhos/meter.

Cartridges prepared, stored and tested as described in Example 1 had a storage life at 40° C. of greater than 20 weeks.

EXAMPLE 27

The procedure of Example 4 was repeated save that the modifier was a mixture of (a) 1 part of a 1:1 molar condensate of polyisobutenyl succinic anhydride (number average molecular weight 1200) and diethanolamine, and (b) 0.5 part of an 1:1 molar condensate of a hydrogenated polyisoprene (number average molecular weight 1000) having a terminal carboxyl group and sorbitol.

The electrical conductivity of the emulsion at 60° C. was 490 picomhos/meter.

Cartridges prepared, stored and tested as described in Example 1 had a storage life at 40° C. of greater than 25 weeks.

EXAMPLE 28

The procedure of Example 4 was repeated save that the modifier was a mixture of (a) 1 part of a 1:1 molar condensate of polyisobutenyl succinic anhydride (number average molecular weight 1200) and sorbitol, and (b) 0.5 part of a condensate of an oxidised polypropylene (number average molecular weight 1500) (having a terminal carboxylic acid group) and tris (hydroxymethyl) aminomethane.

The electrical conductivity of the emulsion at 60° C. was 790 picomhos/meter.

Cartridges prepared stored and tested as described in Example 1 had a storage life at 40° C. of greater than 20 weeks.

We claim:

1. An emulsion explosive composition comprising a discontinuous phase containing an oxygen-supplying component and an organic medium forming a continuous phase characterised in that the oxygen-supplying component and organic medium are capable of forming an emulsion which, in the absence of a supplementary adjuvant, exhibits an electrical conductivity, measured at a temperature of 60° C., not exceeding 60,000 picomhos/meter.

2. A composition according to claim 1 characterised in that the composition comprises an electrical conductivity modifier.

3. A composition according to claim 2 characterised in that the modifier comprises a lipophilic moiety and a hydrophilic moiety.

4. A composition according to claim 3 characterised in that the lipophilic moiety comprises a chain structure incorporating a backbone sequence of at least 10 and not more than 500 linked atoms.

5. A composition according to claim 4 characterised in that the chain structure comprises a polymer of a monoolefin the monomer of which contains from 2 to 6 carbon atoms.

6. A composition according to any one of claims 3 to 5 characterised in that the lipophilic moiety comprises a poly[alk(en)yl]succinic anhydride.

7. A composition according to claim 6 characterised in that the lipophilic moiety comprises poly(isobutylene)succinic anhydride.

8. A composition according to claim 3 characterised in that the lipophilic moiety comprises a polymer obtained by interesterification of at least one saturated or unsaturated long chain (up to 25 carbon atoms) monohydroxy monocarboxylic acid.

9. A composition according to claim 8 characterised in that the lipophilic moiety comprises poly(12-hydroxystearic acid).

10. A composition according to any one of claims 3 to 9 characterised in that the hydrophilic moiety comprises a polar organic residue having a molecular weight not exceeding 450.

11. A composition according to any one of claims 3 to 10 characterised in that the hydrophilic moiety is monomeric or oligomeric.

12. A composition according to claim 11 characterised in that the monomeric hydrophilic moiety is derived from a polyol, an internal anhydride thereof, an amine, an amide, an alkanolamine or a heterocyclic.

13. A composition according to claim 11 characterised in that the oligomeric hydrophilic moiety comprises a poly(oxyethylene) group containing not more than 10 ethylene oxide units.

14. A composition according to any one of claims 2 to 7 and 10 to 12 characterised in that the modifier comprises a condensate of polyisobutenyl succinic anhydride and ethanolamine.

15. A composition according to any one of the preceding claims characterised in that it comprises an emulsion which, in the absence of a supplementary adjuvant, exhibits an electrical conductivity, measured at a temperature of 60° C., not exceeding 2,000 picomhos/meter.

16. A process for producing an emulsion explosive composition comprising emulsifying an oxygen-supplying component and an organic medium to form an emulsion in which the oxygen-supplying component forms at least part of the discontinuous phase and the organic medium forms at least part of the continuous phase characterised in that the emulsification is effected in the presence of a modifier which is capable of reducing the electrical conductivity, measured at a temperature of 60° C., of an emulsion formed from the oxygen-supplying component and organic medium, in the absence of a supplementary adjuvant, to a value not exceeding 60,000 picomhos/meter.

17. An explosive charge comprises an emulsion explosive composition according to any one of claims 1 to 15.

* * * * *